US007909085B2

(12) United States Patent
Benedetti et al.

(10) Patent No.: US 7,909,085 B2
(45) Date of Patent: Mar. 22, 2011

(54) PROCESS AND PLANT FOR PRODUCING METAL STRIP

(75) Inventors: Gianpietro Benedetti, Tricesimo (IT); Alfredo Poloni, Fogliano Redipuglia (IT); Nuredin Kapaj, Udine (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 314 days.

(21) Appl. No.: 12/090,871

(22) PCT Filed: Oct. 20, 2006

(86) PCT No.: PCT/IB2006/002950

§ 371 (c)(1), (2), (4) Date: Apr. 21, 2008

(87) PCT Pub. No.: WO2007/045988

PCT Pub. Date: Apr. 26, 2007

(65) Prior Publication Data

US 2008/0251232 A1 Oct. 16, 2008

(30) Foreign Application Priority Data

Oct. 21, 2005 (IT) ..... RM2005A0523

(51) Int. Cl.
*B22D 11/12* (2006.01)

(52) U.S. Cl. ..... 164/476; 164/477; 164/417

(58) Field of Classification Search ..... 164/417, 164/476, 477

See application file for complete search history.

(56) References Cited

U.S. PATENT DOCUMENTS 4,953,615 A 9/1990 Hulek (Continued)

FOREIGN PATENT DOCUMENTS

DE 10310357 9/2004

(Continued)

OTHER PUBLICATIONS

Kruger D et al.; "CPR—A Combined Casting/Rolling Process for Producing Steel Strip"; Iron and Steel Engineer, Assoc. of Iron and Steel Engineers. Pittsburgh, U.S.; vol. 72, No. 5; May 1, 1995: pp. 31-36.

*Primary Examiner* — Kevin P Kerns

(74) *Attorney, Agent, or Firm* — Gifford, Krass, Sprinkle, Anderson & Citkowski, P.C.

(57) ABSTRACT

Process and ultracompact plant for continuous production of hot rolled steel strip comprising an ingot mould (15) which produces a very thin slab at a speed between 4 and 16 m/min, wherein the thickness of the narrow sides is between 15 and 50 mm with a central swelling. Such slab has a core in which the steel is still liquid; it is run through a vertical pre-rolling device (16) which reduces the thickness of the slab, flattening it. The solidified slab can thus undergo a first light rolling process using a pinch roll (17) and, by forming a free curve, it moves to a horizontal position where it can undergo a second light rolling process by another pinch roll (22'). A heating process (if required) includes an inductor (50). A superficial descaling process and a series of reductions in a rolling mill made up of at least three stands (20', 20", 20''') are provided maintaining a slab temperature along the train above the Ar3 recrystallization point. Downstream of the rolling mill, there is a conveyor (31) with cooling showers (32), flying shears (33) for cutting the strip to the required size, pinch rolls and at least two coilers (34) for forming coils of the hot rolled strip.

16 Claims, 10 Drawing Sheets

U.S. PATENT DOCUMENTS

| | | | |
|---|---|---|---|
| 5,479,982 | A | 1/1996 | Hoffken et al. |
| 5,634,257 | A | 6/1997 | Kajiwara et al. |
| 5,832,985 | A | 11/1998 | Pleschiutschnigg et al. |
| 2005/0167076 | A1 | 8/2005 | Hennig et al. |

FOREIGN PATENT DOCUMENTS

| | | | |
|---|---|---|---|
| EP | 0286862B1 | A1 | 10/1988 |
| EP | 0382151B1 | A2 | 8/1990 |
| EP | 0743116 | | 11/1996 |
| WO | 2004065039 | A1 | 8/2004 |

PROCESS AND PLANT FOR PRODUCING METAL STRIP

CROSS REFERENCE TO RELATED APPLICATIONS

This application is the U.S. national phase of PCT/IB2006/002950 filed Oct. 20, 2006, which claims priority of Italian Patent Application No. RM2005A000523 filed Oct. 21, 2005.

FIELD OF INVENTION

The present invention relates to a process and a plant for continuous production of hot rolled metal strip, starting from ultra thin slabs produced at high casting speed.

STATE OF THE ART

Processes and plants for producing hot rolled steel strips are known in the state of the art, including traditional slabs with a thickness of 150-320 mm or normal thin slabs with a thickness of about 60-90 mm.

Such plants include at least an ingot mould connected at its bottom exit to a curved roller conveyor able to contain and guide the cast slab into the passage from the casting vertical direction to the rolling horizontal direction. Normally the metallurgical cone, namely the central zone of the conical slab in which the steel remains liquid, extends outside the ingot mould and closes along the curved path, thus the solidification is completed in the roller conveyor.

The rollers located near the metallurgical cone also exert a pressure on the solidified skin in order to perform a soft reduction of the slab in order to obtain a thinner thickness at the end of the casting machine. Furthermore, the roller conveyor is associated with secondary cooling systems of the slab made up of, for instance, a large number of spraying nozzles.

Downstream of the casting machine, and in line with it, there are normally shears for cutting the product to the required size, a long tunnel type furnace for retrieving the temperature of the single slabs to make them suitable for rolling, a descaling device and a rolling mill, made up of six or more stands, which reduces the thickness of the slabs in order to obtain the value required for the strip. Since the passage through each stand and the relative reduction in thickness will cool down the strip, in order to maintain the temperature of the material above the $Ar_3$ recrystallization point, and thus keep rolling within an austenitic field, the machines of the known technique also include inductors located between rolling stands to heat the strip being rolled to a suitable temperature.

Finally, downstream of the rolling mill, there are cooling systems for the strip, shears for cutting the strip to the required size and coiling devices winding the strip in coils having a predetermined weight.

One of the problems that can be found in such production lines involves the total extended length of the line, which has an effect upon the investment costs as well as the production energy costs and costs of maintenance.

Another problem with the implants of the prior art relates to the discontinuity of the production process in which the supply to the rolling mill is interrupted, making it impossible to perform rolling without interruption, i.e. "endless" rolling, with subsequent negative repercussions on energy consumption and environmental impact.

Thus, it is necessary to achieve a plant and a relevant production process of hot rolled strips suitable to operate continuously which will allow the installation of an extremely compact production line with a significant reduction in production costs per ton.

To this end, great efforts have been made to achieve various "non-endless" solutions; however the areas occupied and the number of rolling stands required for reducing the thickness to the values required are still too high.

The need is also felt to develop a process for manufacturing hot rolled strip with a thin thickness and of a high commercial grade that can be used, in many applications, instead of cold rolled products.

SUMMARY OF THE INVENTION

The main purpose of the present invention is to achieve a highly compact plant and a continuous process for the production of hot rolled steel strip, starting from ultra thin slabs produced at high continuous casting speed.

Another purpose of the invention is to obtain a hot rolled strip with thickness between 0.8-12 mm, with a fine-grained internal structure so uniformly distributed that it will have to already include the features of a cold rolled material, hence high-quality and flawless features.

Another purpose is to achieve an endless plant for producing hot rolled coils directly starting from the liquid steel, with productivity of 500,000-1,500,000 tons/year, able to reduce the investment costs and running costs when compared with a traditional plant for producing the same strip thicknesses.

Another equally-important purpose is to achieve a plant able to economically exploit the productive potential of an ingot mould capable of producing an ultra thin slab.

Therefore, the present invention intends to solve the above-mentioned problems and to achieve the above objectives through a continuous production process of hot rolled metal strips which includes an ingot mould, with a built-in crystallizer, a liquid core pre-rolling device, located near the exit section of the crystallizer, a first pinch roll, a path deflecting and guiding device which can be operated at least during predetermined periods of time, a second pinch roll, a third pinch roll and straightening device, heating devices and/or devices for keeping the heat constant, a descaling device and at least three rolling stands, wherein the process comprises the following stages without intermediate interruptions:

a) casting of a thin slab exiting the crystallizer at a speed of 4-16 m/min, with narrow sides between 15 and 50 mm and a core in which the steel is in a liquid state,
b) implementation of a soft reduction of the slab through said pre-rolling device so as to obtain a completely solidified cast product with thickness between 15 and 40 mm,
c) formation on the cast product of a free curve located between said first and said second pinch roll,
d) implementation of a descaling operation on the cast product by means of said descaling device,
e) implementation in succession of a plurality of rolling operations through said rolling stands on the cast product, thus eventually defining a strip with thickness between 0.8 and 12 mm.

Such process is implemented, according to another aspect of the present invention, through an endless plant for continuous production of hot rolled metal strips which includes an ingot mould with a built in crystallizer able to produce a thin liquid core slab with thickness between 15 and 50 mm, a liquid core pre-rolling device located near the exit section of the crystallizer, a first pinch roll, a second pinch roll, a third pinch roll and straightening device, heating devices and/or devices for keeping the heat constant, a descaling device and at least three rolling stands.

wherein a deflecting and guiding device of the cast product is located between said first and second pinch roll which can be operated at least during predetermined periods of time, from a vertical path to a horizontal path, able to disengage the cast product under normal operating conditions so as to allow the formation of a free curve of the cast product between said first and second pinch roll.

The following lists the features of the process and of the plant according to the present invention, thus pointing out their advantages.

In the tundish, systems may be advantageously used for heating the molten steel so as to suitably ensure an efficient and reliable control of the over-temperature of the steel in the tundish relative to its "liquidus" temperature, said over-temperature being also known as "superheat", during the casting. Preferably, a plasma torch can be used to correct the superheat values of the molten steel and particularly to retrieve possible drops in temperature in the tundish—especially when starting the casting, when the heat absorption of the tundish is more intense—thereby ensuring its absence of solidification; compared to other known heating devices, using a plasma torch does not create fluid dynamic problems in the tundish; it allows for the fluctuation of the inclusions and ensures a consistent temperature distribution of the molten steel. Advantageously, the superheat is kept relatively low and constant, in favour of a better metallurgical quality of the end product, typically around 20° C. As a result, a constant superheat makes it possible to obtain an equiaxed structure and ensure the uniformity of the features over the whole cast product.

The ingot mould is able, by means of the crystallizer, to cast a slab much thinner than the thickness that can be achieved with known ingot moulds at very high speed (between 4 to 16 m/min) between an interval of 15-50 mm, in which the core remains liquid even near lateral end zones; advantageously, the basin or casting chamber of the crystallizer is such as to ensure enough space to prevent the molten steel jets of the nozzle from causing an unwanted remelting phenomenon of the skin formed around its internal surface, especially starting at a certain distance from the nozzle, which is the largest area of the jet section. Casting a very thin thickness at high speed requires higher cooling speed in the ingot mould: such accelerated cooling advantageously makes it possible to achieve a finer microstructure of the product.

The nozzle is preferably of the multiport type; its shape is complementary with the funnel of the crystallizer to avoid solidification bridges. Advantageously, the flow of the nozzle is controlled in such a way as to allow suitable melting of the lubrication powders to the meniscus as well as a suitable diffusion toward the lateral zones, thus modulating—according to the casting speed—the parts of flow which bring molten steel toward the meniscus and toward the lateral zones of the crystallizer, for example by using electromagnetic devices.

Thanks to the presence of a liquid core while as the slab comes out of the ingot mould, it can be subjected to the liquid core pre-rolling, also called "soft-reduction", thereby obtaining a refinement of the core structure which starts to become solid, together with the reduction of the internal porosity and with the elimination of the central segregation phenomenon. Advantageously, the liquid core pre-rolling is dynamically performed in a controlled manner so as to correctly setup the closing point of the liquid cone during the transients associated with the variations that may occur in the casting parameters with respect to the normal operating conditions. Hence, a high-quality slab can always be achieved in any operating condition.

The apex of the liquid cone, i.e. the so-called "kissing point", which is where the two shells join, is located at a short distance below the ingot mould, advantageously in the vertical section between the exit section of the ingot mould and the distance between the axes of the pinch roll below it; thus the roller conveyor performing the "soft-reduction" is relatively short, hence resulting in space saving.

Immediately after exiting the "soft-reduction" section, there is a first pinch roll which can advantageously perform a first thickness reduction on the solidified product, also called "hard reduction"; such thickness reduction is between 0.5 and 3 mm hence as it is still relatively limited and performed on the product which is still very hot, it requires low crushing forces. Such first light rolling process provides additional quality, especially internal quality, of the product because it closes the interdendritic paths between the grains by compacting the structure. Furthermore, it allows for an advantageous dynamic recrystallization of the material which prevents the precipitation of the aluminum compounds on the grain boundary, hence providing a more uniform structure; additionally, such recrystallization prevents the formation of superficial cracks and burst edges during the subsequent rolling process.

After the "hard reduction", the cast product will already have a dimension and thickness similar to that of a strip, which is why it is also called "pre-strip", and it follows a curved path to pass from the casting vertical direction to the rolling horizontal direction, without being guided by a guiding device. Since the temperature of the pre-strip is still high, giving the material good ductility properties, it is able to rise and to lower a certain amount along the curved path. This free curve will thus create an uncoupling between the upstream and downstream sections and release, of a certain measure, the casting process from the rolling process, providing flexibility to a system which in itself would be rigid since it is "endless"; thus such flexibility makes it possible to obtain the advantages of a "semi-endless" system, such as less sophisticated and less complex process control equipment since no drawing control is necessary along the production line. Basically, such curve is in the shape of a semi-circular arc during normal system operation.

In order to also control the starting phase of the casting process, which is a passing phase during which the slab maintains the thickness exiting the ingot mould along the whole production line, there is a temporary deflecting and guiding device of the cast product along the curved path which may include a single or double curved roller conveyor pivoting about one end thereof, or a curved roller conveyor sliding sideways mounted on an appropriate trolley. As soon as the process starts its normal operation, the roller conveyor disengages in order to release and free the cast product, thereby allowing its free flotation along the curved path. Another advantage of the temporary deflecting and guiding device in the shape of an opening curved roller conveyor is to operate more easily when freeing the casting line in case of cobble in the rolling mill or a casting machine malfunction, such as for example a breakout or sticking in the ingot mould. In fact, while a conventional roller way for containment and guide of the slab is fixed and complex (rigid system), which would particularly complicate the operations to clear out the line, by using the roller conveyor of the system according to the invention, it is possible to quickly free the casting line and restart production without particular waste of time or additional setups. In case of cobble in the rolling mill or a breakout or sticking in the ingot mould, the molten steel situated upstream will stop the flow and the slab is quickly and completely cleared out of the vertical casting line by cutting it into one piece or in several lengths with appropriate cutting devices such as an oxygen lance cutting device, wherein said lengths can fall freely into a large bin located vertically under the ingot mould. Advantageously, said oxygen lance cutting device performs, transversely in relation to the casting direction, one or more strokes at least equal to the width of the slab to be cut, while it advances slowly and is controlled by specific and totally automated robots; in addition, the collecting bin is wheeled thus it can move by means of metal ropes or other known equipment.

At the beginning of the horizontal section of the rolling fine there are a second and a third two-roller pinch roll; said second or said third pinch roll can advantageously perform a light thickness reduction of the pre-strip and thus a second "hard reduction" exactly as the first pinch roll placed at the exit of the "soft-reduction" section, hence a reduction of about 0.5-3 mm.

The third pinch roll advantageously straightens and guides the head of the slab or of the pre-strip, which would have the tendency to divert upwards at the exit of the second pinch roll.

Downstream of the third pinch roll and straightening device rotary drum shears can be installed, for use mainly at the start of the casting process and to cut long lengths of slab until the maximum casting speed is reached and, thus, until the system reaches its normal operating speed; they are also used for all emergency situations, for example a breakout or sticking in the ingot mould or a cobble in the rolling mill, and can be used to separate the head of the dummy bar when required.

Downstream of the drum shears heating systems and/or systems for keeping the temperature constant are advantageously installed to ensure the correct temperature of the product when entering the first rolling stand in any running condition. Such systems can be active—for instance induction heating furnaces or simply inductors—or passive—for example insulated hoods or insulating panels. Since the thermal losses of the product along the casting path are quite limited in comparison to conventional systems, according to the above, the scaling of said systems will result in limited overall dimensions, in other words the length will be between 1 and 2 m. Advantageously, at the exit of one of said systems, the product must have a homogeneous temperature of at least 1,000° C. or such as to guarantee a temperature of at least 850° C. at the exit of the rolling mill. In the case of an induction heating system or simply an inductor, for example, a power of 3-5 MW at 3000 Hz is required to ensure such temperature value.

The specific power being used, as well as the possible use of the inductor, are determined by the casting conditions, particularly by the casting speed and by the thickness after the "soft-reduction": such parameters determine the so-called "mass flow": this value is associated with the temperature of the product at the end of the rolling mill. The inductor can only suitably heat the edges, if necessary, or it can completely heat up the whole pre-strip. It can be on or off, as needed; furthermore, its power is more limited than those that are known and used in similar systems inasmuch as the cast product to be heated has a thinner thickness. The inductor can advantageously be wheeled so that it can be put out of service laterally with respect to the production line. In the latter hypothesis, it allows easy access to the drum shears, for example to change the cutters.

Right above the rolling mill, there are systems to remove the scale from the surface of the product, for example a descaling device. The descaling device is advantageously wheeled so it can be put out of service laterally, thereby allowing easier maintenance and better access to the first stand. The descaling device can be static or dynamic, e.g. rotary; it uses water at a very high pressure and at a very low flow rate to minimize the surface cooling while totally ensuring the removal of the entire surface scale of the, cast product before entering the rolling mill.

The rolling mill is made up of at least three rolling stands of the four-high type; these stands may be identical or different in size and set up in tandem in a fixed position; a few stands are enough because the entering product already has a reduced thickness, since it has undergone the "soft-reduction" and one or two "hard-reductions", respectively, of the ultra thin slab. If the maximum thickness of the slab (e.g. 50 mm) is cast, but neither of the two "hard reductions" is carried out, a fourth stand will be advantageously added. However, the number of the stands is lower compared to those resulting from the state of the art, hence obtaining a compact rolling mill. The slab undergoing only the "soft-reduction" or liquid core pre-rolling is called cast product; whereas the slab undergoing at least one "hard-reduction" is called pre-strip.

According to the process of the invention, inductors located between rolling stands are not necessary to maintain the correct austenitic rolling temperature, hence resulting in space and money saving. The percentage of reduction of the product during rolling varies according to the final width of the strip, notwithstanding the rolling force.

The following devices are installed downstream of the rolling mill: guillotine shear (optional), a roller conveyor with cooling showers, flying shear for cutting the strip to the required size, pinch rolls and at least two coilers, for example of the "downcoiler" type.

Said guillotine shear, in accordance with another embodiment of the invention, is installed in place of the drum shears, upstream of the inductor, and placed immediately after the exit of the rolling mill with the advantage of making the part of the system upstream of the rolling mill more compact; it is mainly used for cutting long lengths of slab produced during the initial phase of the casting, until the maximum casting speed is reached;

of strip produced during the subsequent phase of closing the stands of the rolling mill in which an off-gauge product is obtained.

It can also be used to separate the head of the dummy bar from the cast slab at the start of the process when required. Advantageously, the dimensions of the guillotine shear is more limited in comparison to those that are known inasmuch as the maximum thickness of the thin slab to be cut is, in any case, reduced.

A terminal area downstream of the coils is used as a deposit for the long lengths of slab cut either by the drum shear or by the guillotine shear. This solution will eliminate the need to have a large dedicated scrap bin placed near the drum shear or guillotine shear, hence simplifying the foundations and allowing a more efficient layout.

The flying shear for cutting to the required size is used, in normal operating conditions, to cut the strip to the required size in order to obtain the required "coil" weight.

To start the casting process, the head of the dummy bar can be inserted into the terminal part of the crystallizer in two ways. The first consists of sending the dummy bar along the entire line starting from the terminal area downstream of the downcoilers where it is parked; in this way the dummy bar passes through the whole of the rolling mill, which is at a standstill with the stands open, and via the curved roller conveyor it passes from the horizontal to the vertical direction before entering the crystallizer. When casting has started, the head of the dummy bar is separated from the slab either by the drum shear or by the guillotine shear. The second method, instead, consists of inserting the dummy bar directly from the bottom into the vertical axis of the ingot mould. To implement this particular solution, the dummy bar is contained in a sliding wheeled device that is moved up to the casting line; inside the wheeled device there are powered rollers to move and guide the dummy bar and it is also equipped with a roller device for separating the head of the dummy bar after starting.

The whole production process described so far, from the molten steel in the tundish to the strip, is advantageously monitored by special area controllers which control different components of the system by interacting between each other; such area controllers refer to a supervisor which operates on the different variables involved making them interact methodically in order to stabilize the process with respect to the variations of the steady-state operating conditions as well as to disturbances and anomalies interfering with the system. Thus the process is totally controlled in an active, smart and dynamic way, hence resulting in a "smart full dynamic process".

The high speed of the cast product in the shape of an ultra thin slab and the direct connection with the rolling mill—which convert it into a strip starting from a thickness thinner than that used in known casting processes with a lower number of stands—as well as the total reduced length of the production line, allow for less impact on civil engineering, such as foundations, industrial warehouse height, pipelines, infrastructures, etc. This advantageously entails lower first investment and operating costs as well as less maintenance compared to an installation known in the art.

Furthermore, casting a very thin slab as well as carrying out a liquid core thickness reduction on it, "soft-reduction", followed—if necessary—by a solidified core reduction, "hard-reduction", allows the possibility to achieve a cast product/pre-strip thin enough to form a free floating curve; said free curve has the remarkable advantage of uncoupling the casting and the rolling processes, thus making the system more flexible.

The process and the plant, according to the present invention, give the possibility to achieve different preferred embodiments, some examples of which are described hereinafter thus summarizing some process parameters/conditions as well as the thicknesses obtained along the production line:

EXAMPLE 1

Described in FIG. 2

Casting speed: 10 m/min
Slab thickness exiting the ingot mould (narrow sides): 32 mm
Thickness after "soft reduction": 22 mm
First "hard reduction": no
Second "hard reduction": no
Rolling stands: 3
Final thickness of a 1100 mm wide strip: 2.2 mm
Final thickness of a 1300 mm wide strip: 2.3 mm
Final thickness of a 1500 mm wide strip: 2.9 mm

EXAMPLE 2

Described in FIG. 3

Casting speed: 10 m/min
Slab thickness exiting the ingot mould (narrow side): 32 mm
Thickness after "soft reduction": 22 mm
Thickness after first "hard reduction": 20 mm
Second "hard reduction": no
Rolling stands: 3
Final thickness of a 1100 mm wide strip: 2.0 mm
Final thickness of a 1300 mm wide strip: 2.2 mm
Final thickness of a 1500 mm wide strip: 2.7 mm

EXAMPLE 3

Described in FIG. 4

Casting speed: 10 m/min
Slab thickness exiting the ingot mould (narrow side): 32 mm
Thickness after "soft reduction": 22 mm
Thickness after first "hard reduction": 20 mm
Thickness after second "hard reduction": 18 mm
Rolling stands: 3
Final thickness of a 1100 mm wide strip: 1.8 mm
Final thickness of a 1300 mm wide strip: 2.0 mm
Final thickness of a 1500 mm wide strip: 2.5 mm.

EXAMPLE 4

Described in FIG. 5

Casting speed: 10 m/min
Slab thickness exiting the ingot mould (narrow side): 40 mm
Thickness after "soft reduction": 30 mm
First "hard reduction": no
Second "hard reduction": no
Rolling stands: 4
Final thickness of a 1100 mm wide strip: 1.6 mm
Final thickness of a 1300 mm wide strip: 1.7 mm
Final thickness of a 1500 mm wide strip: 2.0 mm.

EXAMPLE 5

Described in FIG. 5*a*

Casting speed: 10 m/min
Slab thickness exiting the ingot mould (narrow side): 40 mm
Thickness after "soft reduction": 30 mm
Thickness after first "hard reduction": 29 mm
Thickness after second "hard reduction": 27 mm
Rolling stands: 4
Final thickness of a 1100 mm wide strip: 1.5 mm
Final thickness of a 1300 mm wide strip: 1.6 mm
Final thickness of a 1500 mm wide strip: 1.9 mm.

BRIEF DESCRIPTION OF THE FIGURES

Further features and advantages of the invention will be better pointed out in the detailed description of preferred, but not exclusive, merely illustrative and not limitative, exemplified embodiments of a system for producing metal strips, with the aid of the attached drawings wherein.

DETAILED DESCRIPTION OF PREFERRED EMBODIMENTS OF THE INVENTION

Figure 1:
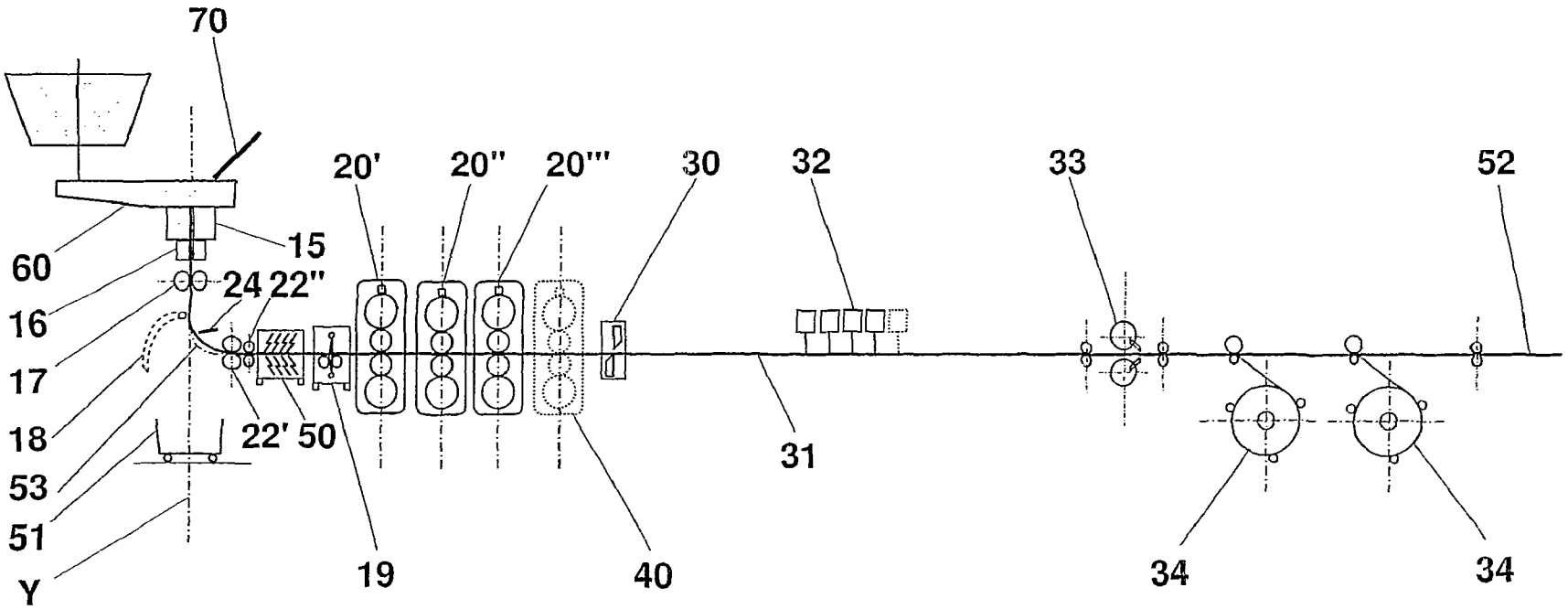
FIG. 1 represents a schematic side view of a system according to the invention.

FIGS. 1, 2, 3, 4, 5 describe a system for the production of metal strips comprising:

- an ingot mould 15 which incorporates a crystallizer 15' for the production of ultra thin slabs having a liquid core,
- a liquid core or "soft reduction" pre-rolling device 16, placed near the exit section of the ingot mould which produces a cast product completely solidified,
- a first pinch roll 17 of the cast product able to pull the cast product and also to perform a light thickness reduction;
- cutting devices 24, for example an oxygen lance cutting device, for cutting the slab in case of an emergency, such as a cobble in the rolling mill or a breakout or sticking in the casting; the device is completely automated and, controlled by suitable robots, cuts the slab transversely in relation to the direction of casting while it is fed forward to free the casting line;
- a temporary deflecting and guiding device 18, 18' for the "non-softed" slab from a vertical path to a horizontal path,
- a large wheeled bin 51 placed vertically under the casting line,
- a second pinch roll 22',
- a third two-roller pinch roll and straightening device 22",
- a heating system 50 of the pre-strip or of the cast product, and/or a system for keeping the temperature constant,
- a descaling device 19,
- rolling stands 20', 20", 20'", at least three,
- guillotine shear 30,
- a set of strip cooling showers 32 placed on a feeding roller conveyor 31 of the strip,
- flying shear for cutting the strip to the required length 33,
- at least two coilers 34,
- a depositing area 52 for the dummy bar and for the long off-gauge lengths of slab cut by the guillotine shear 30.

The ingot mould 15 advantageously produces a very thin slab at a casting speed between 4 and 16 m/min, wherein the thickness of the narrow sides is between 15 and 50 mm with a central swelling and a core which is still liquid. As we continue, when the thickness of the cast slab is mentioned, it will always be considered as the thickness of the extremities, also called "narrow sides".

Advantageously, molten steel heating systems are used in the tundish 60 up-stream of thee ingot mould to ensure efficient and reliable control of the "super-heat" in the tundish during casting. Preferably, said heating systems include a plasma torch 70 to correct the value of the "superheat" of the molten steel which is kept relatively low in favour of a better quality of the end product, typically around 20° C.

A pre-rolling device 16 is located near the exit section of the ingot mould 15, basically with a vertical rolling axis, which includes a group of upper and lower transversal rollers 16' shaped so as to modify the transit section of the slab thus performing a progressive flattening action of the convex or bulged surface, i.e. going out of the crystallizer, in order to bring the slab to a cast product having a rectangular section. The action for recovering the convex shape involves a compression of the liquid core slab until it reaches a thickness equal to the width of the narrow sides of the exit section of the crystallizer.

Advantageously, said transversal rollers 16' can be placed at a closer distance so as to obtain, at the exit of the roller conveyor, a linearized cast product with a thickness more reduced than that going out of the crystallizer: basically, the thickness is reduced on the slab which still has a liquid core, in other words the so-called "soft-reduction" is carried out. According to the invention, the slab is reduced to a thickness of 15-40 mm after the "soft-reduction".

The upper and lower transversal rollers 16' are divided into two or more elements, also called "soft-reduction" segments, each having an independent control, for example via hydraulic cylinders.

The group of transversal rolls 16', operating with an integrated cooling system, also performs a containment and guiding function of the slab, which still has the liquid core.

Advantageously, quick-change devices of the ingot mould 15 are installed as well as sectors for the pre-rolling or "soft-reduction" device 16.

Figure 6:
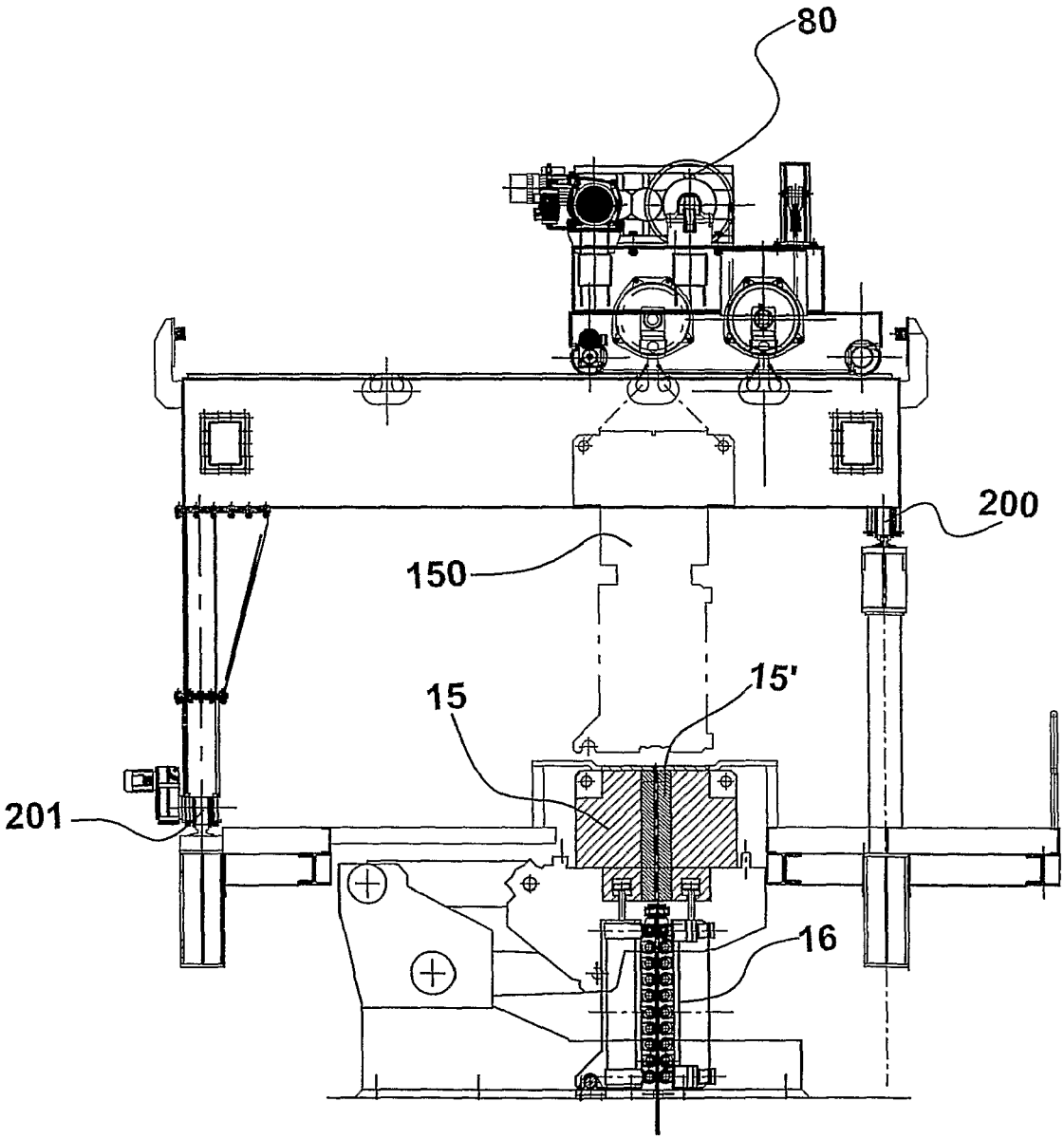
FIG. 6 represents a longitudinal section of a variation of the system in FIG. 1 in a particular operational phase.

A first embodiment of said change devices requires a specific bridge device, for instance a bridge crane 80, as the one described in FIG. 6, whereby it is possible to lift just the ingot mould 15 to position 150, or the ingot mould together with the "soft-reduction" device 16, and subsequently place them in special stalls, for example on the casting floor. In order to easily move the part to be replaced, the bridge crane 80 can slide on special rails by means of rollers 200, 201.

Figure 7:
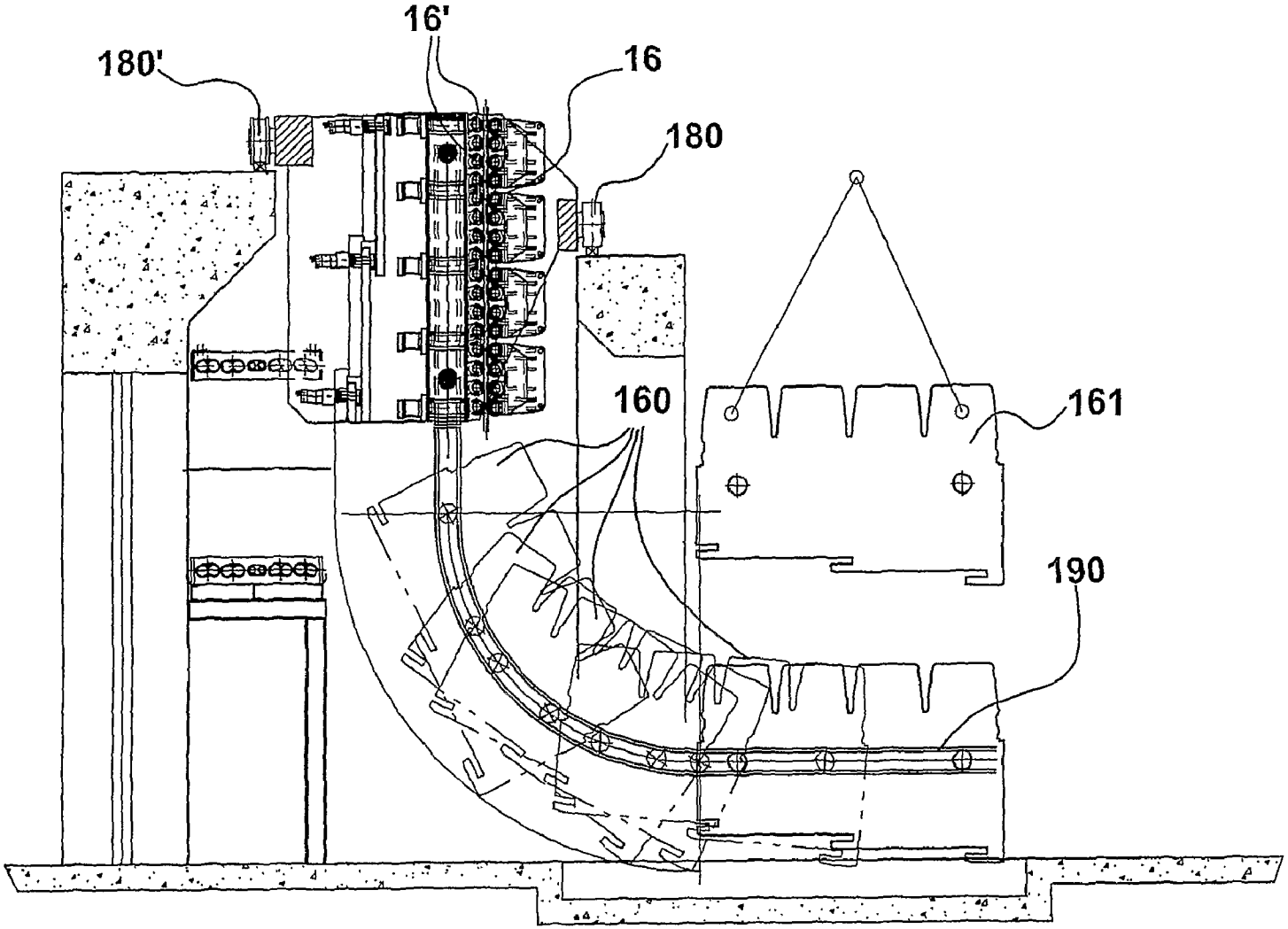
FIG. 7 represents a longitudinal section of a variation of the system in FIG. 1 in another particular operational phase.

A second embodiment of said change devices requires the pre-rolling device 16 to be slid, on suitable transversal tracks, by means of rollers 180, 180' visible in FIG. 7, whereas the ingot mould is lifted from above for example by a bridge crane (not described).

On the other hand, in addition to said transversal tracks for sliding the pre-rolling device 16 sideways relative to the casting axis, a third embodiment also requires vertical-curve tracks 190 to allow the pre-rolling device 16 to make its next descent on the plane below, as described in FIG. 7. Some of the positions 160 occupied by the device 16 during the descent are shown in FIG. 7 with thinner lines. At this stage, the device 16 is disabled, and a second alternative device 161, which runs the opposite way, is automatically operated along the vertical-curve tracks, hence brought to its operating position in line with the casting axis. In this case, the ingot mould 15 may also be lifted from above and replaced with a crane (not described). These operations, when carried out with said change devices, can be operational change operations, e.g. for changing the format of the slab to be cast; they can also be change operations in emergency situations, e.g. when a cobble occurs on the rolling mill or a "breakout" occurs in the ingot mould.

Immediately downstream of the group of rolls 16' there is a first pinch roll 17 which includes two cylinders 17', 17" which pull out the product cast by the ingot mould; the size of such cylinders has been studied to also reduce the thickness of the cast product by applying a suitable crushing force on it. More specifically, said cylinders 17', 17" perform a rolling force on the cast product downstream or at least near the closing point of the liquid cone, also called "kissing point"; by doing so, the action of the cylinders 17', 17" is carried out on the cast product completely solidified. Thus, a real rolling process, also called "hard reduction", is achieved.

In accordance with the present invention, after the "hard-reduction", the cast product comes out with a thickness between 12 and 37 mm thus achieving a product, called pre-strip, very close to the final thickness of the strip to be produced. Such rolling process provides additional quality, especially internal quality, of the product inasmuch as it closes the interderidritic paths between the grains by compacting the structure.

In order to also control the starting phase of the casting process, which is a passing phase, a temporary deflecting and guiding device 18 is installed which includes a double opening curved roller conveyor located immediately below the two cylinders 17', 17". The curved roller conveyor 18, 18' is also necessary to guide and introduce the head of the dummy bar in the crystallizer 15'. When the casting begins, the slab pulled by the dummy bar does not have a liquid core, hence it is not possible to reduce its thickness with the "soft-reduction"; additionally, the two cylinders 17', 17" do not act upon the crushing action. Therefore, the first portion of the cast slab has a thickness equal to that of the section exiting the ingot mould along the whole line, up until the exit of the third rolling stand 20'" or fourth rolling stand 40, thus in this first phase it is conventionally called "non-softed slab". The size of the curved roller conveyor 18, 18' has been designed so as to apply a force strong enough to curve the "non-softed slab". The guiding rolls 23 of the curved roller conveyor 18, 18' are idle and the support of the roller conveyor is kept in an active position by special hydraulic jacks 21, 21'. Both the lower part 18 and the upper part 18' of the curved roller conveyor are hinged in order to allow them to rotate and to disengage from the cast product when it is necessary to clear out the path followed by the pre-strip under normal operating conditions and when it is necessary to unload all the material in the pit during emergency conditions, e.g. a cobble. When the curved roller conveyor 18, 18' is opened, the positions of the lower and upper parts are shown with thin lines in FIG. 2.

As mentioned above, at the end of the transient starting phase, the casting is carried out under normal operating conditions and the two parts 18, 18' of the roller conveyor are in an opening position thereby allowing the pre-strip to form a free curve 53 basically in the shape of a semicircular arc with the system in the normal operating condition.

The presence of the free curve 53 provides remarkable advantages:

a) it uncouples the casting process from the rolling process further downstream, thereby controlling possible speed differences between the rolling and casting process;
b) it gives the plant more flexibility, thus allowing, for example, the use of less sophisticated and less complex process control equipment since no pull control is necessary along the production line;
c) it reduces the pre-strip cooling because there is no heat exchange by conduction with the support and guide-rollers of conventional systems;
d) it prevents implications on the ingot mould level control with major castability and quality advantages of the slab.

According to the present invention, the free curve is left to float within a predetermined interval defined by the possible geometry of the curve itself and the characteristics of the material; in this manner it is possible to have controlled flow of material and thus, always within previously defined limits, completely uncouple the speed upstream of the curve from that downstream. The control system continuously monitors the position of the free curve, for example by means of a probe, in relation to the predetermined upper and lower limits and intervenes when the curve approaches one of said limits acting on system components on the basis of predetermined control processes.

Along the pre-strip line of travel, after the curve, there is a second two-roller pinch roll 22' or second "pinch-roll" which pulls the "non-softed slab", in case of a transient phase, or the pre-strip, in case of normal operating conditions, and performs, if necessary, a second light rolling operation. The pre-strip is 9-34 mm thick when exiting this second pinch roll 22'.

In the second "pinch-roll" 22', the lower roll 25 preferably has the same dimensions as the upper roll. In one variation, the diameter of the lower roller 25 of the second "pinch-roll" 22' may be bigger than the upper roller so as to have a suitable supporting surface for the curve 53 formed by the pre-strip during the operational process.

Both the first 17 and second 22' pinch roll are advantageously provided with systems to perform a quick change of the cylinders.

Figure 2:
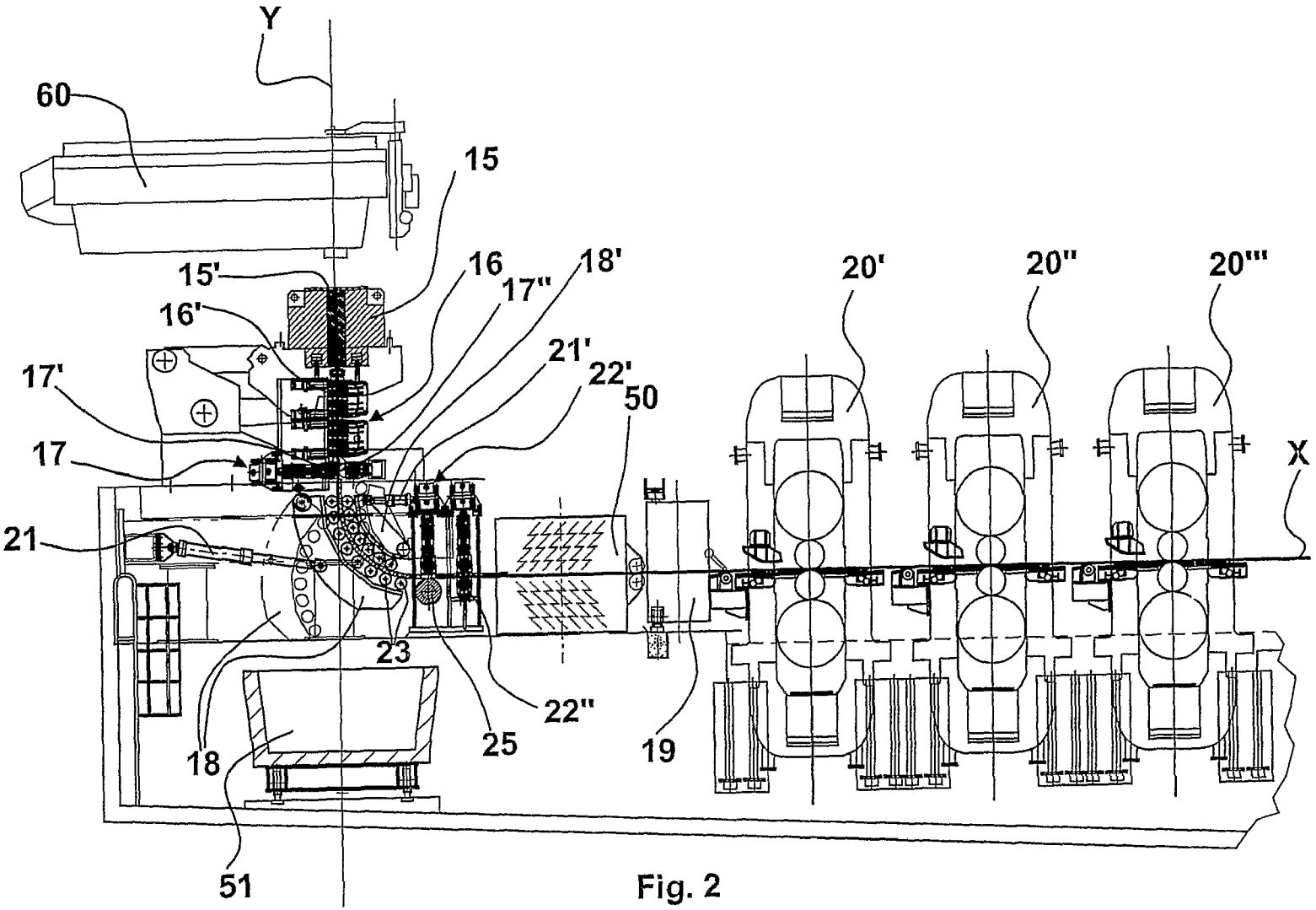
FIG. 2 represents a longitudinal section of a first embodiment of part of the system in FIG. 1.
Figure 3:
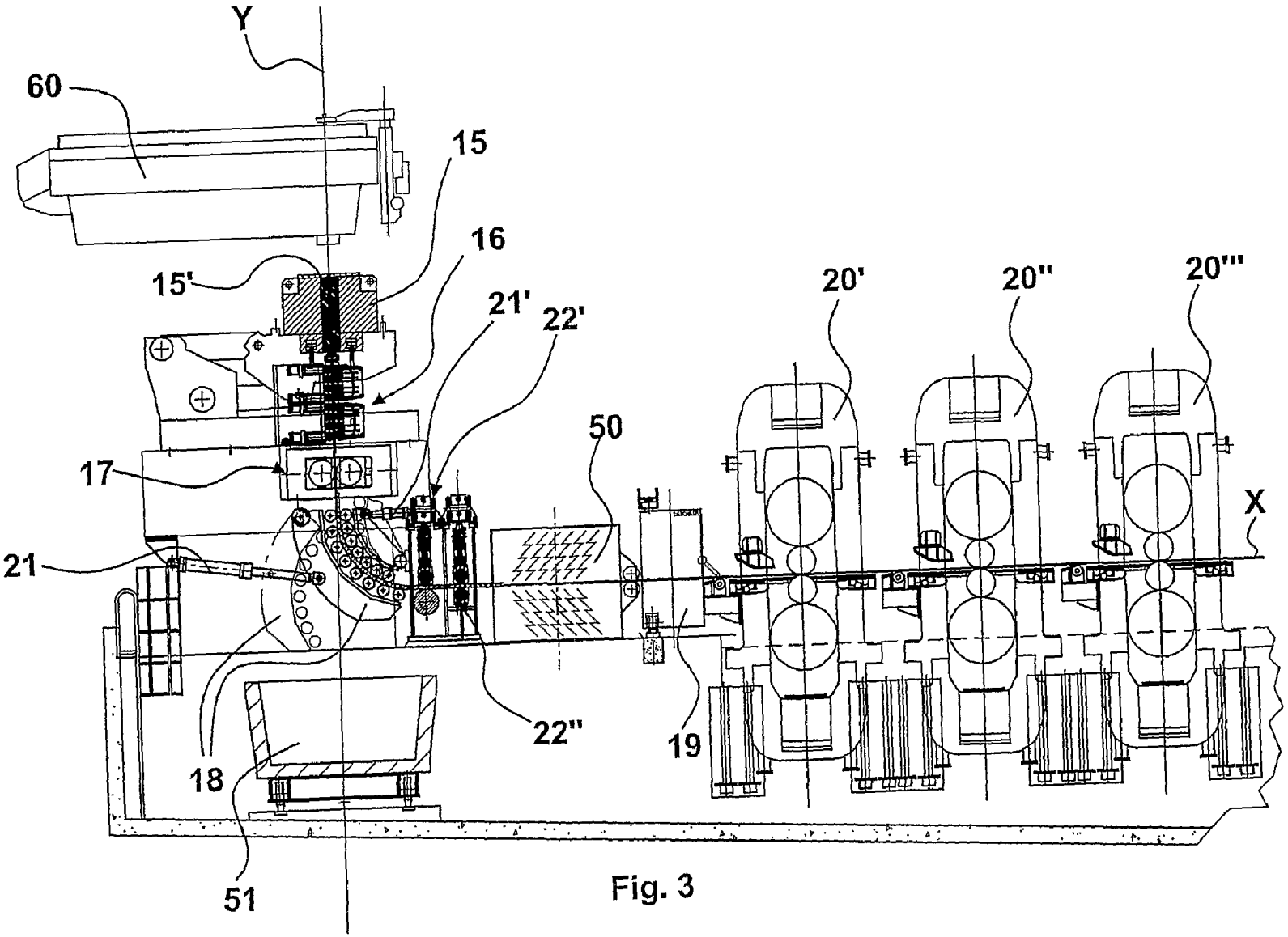
FIG. 3 represents a longitudinal section of a second embodiment of part of the system in FIG. 1
Figure 4:
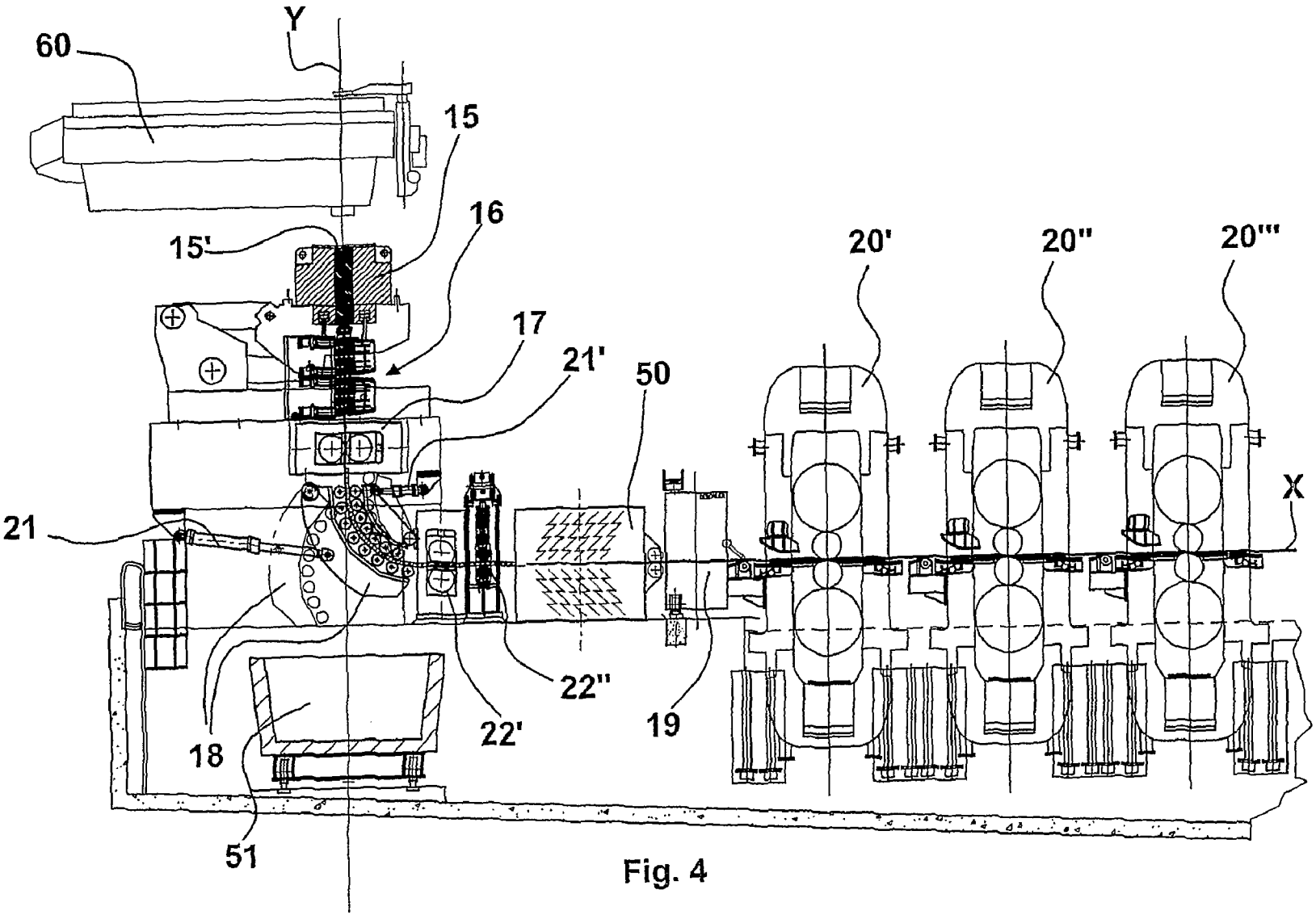
FIG. 4 represents a longitudinal section of a third embodiment of part of the system in FIG. 1.

FIGS. 2-4 represent longitudinal sections of some embodiments of the system, according to the present invention.

In FIG. 2, device 17 and device 22' preferably serve as pinch rolls of the cast product and do not perform rolling or "hard-reduction" operations.

In FIG. 3, device 17 preferably serves both as a pinch roll and as a rolling stand while device 22' preferably serves only as a pinch roll.

Instead, in FIG. 4, both pinch rolls 17, 22' serve also as rolling stands, thus performing two "hard-reductions".

Generally, said first and second pinch rolls 17, 22' can also perform a rolling operation on the cast product and/or on the pre-strip; in this case, the diameter of their cylinders is between 300 and 500 mm.

A third pinch roll and straightening device 22" of the pre-strip head are advantageously placed after the second pinch-roll 22'.

Downstream of the third pinch roll and straightening device 22", heating systems 50 and/or systems for keeping the temperature constant are advantageously installed to ensure the correct temperature of the product when entering the first rolling stand 20' in any working condition. Such systems 50 can be active—for instance induction heating furnaces—or passive—for example insulated hoods or insulating panels.

Since the thermal losses of the product along the casting path are quite limited, said systems 50 have limited overall dimensions wherein the length is between 1 and 2 m. Advantageously, at the exit of one of said heating systems, the product must have a homogeneous temperature of at least 1.000° C. or such as to guarantee at the exit of the rolling mill a temperature of at least 850° C. In the case of an induction heating system or simply an inductor, for example, a power of 3-5 MW at 3000 Hz is required to ensure such temperature value.

The power level being used, whether the inductor is used or not, is determined by the casting conditions, particularly by the casting speed and by the thickness after the "soft-reduction": such parameters determine the so-called "mass flow"; this value is associated with the temperature of the product at the end of the casting line.

Right above the rolling mill, there are systems to remove the scale from the surface of the product, for example a water rotating descaling device 19.

The water flow rate adjustment of the descaling device is made according to the casting speed:

The rolling mill is made up of at least three, rolling stands 20', 20", 20'" of the "fourth" type. These stands may be identical and set up in tandem in a fixed position; a few stands are enough because the entering product already has a reduced thickness, since it has undergone the "soft-reduction" and one or two "hard-reductions", respectively. If the maximum thickness of the slab (equal to 50 mm) is cast, but neither of the two "hard reductions" is carried out, a fourth stand 40 will be advantageously added and/or a longer liquid core pre-rolling device 16 will be used according to another embodiment of the system described in FIG. 5.

The following devices are installed downstream of the rolling mill: guillotine shear 30, a roller conveyor 31 with laminar water cooling showers 32, flying shear 33 for cutting the strip to the required size, and at least two coilers 34, for example of the "downcoiler" type.

Downstream of the reels is a terminal area 52 for depositing the dummy bar and the off-gauge lengths of slab cut by the guillotine shear 30. Said guillotine shear can be of the following type: pendulum, linkage, wheeled, rotary; however, it should be suitable for cutting big thicknesses at low material feeding speeds.

The flying shear 33 are used, under normal operating conditions, to cut the strip to the required size in order to obtain a roll or "coil", whose weight is about 30 tons.

Figure 1A:
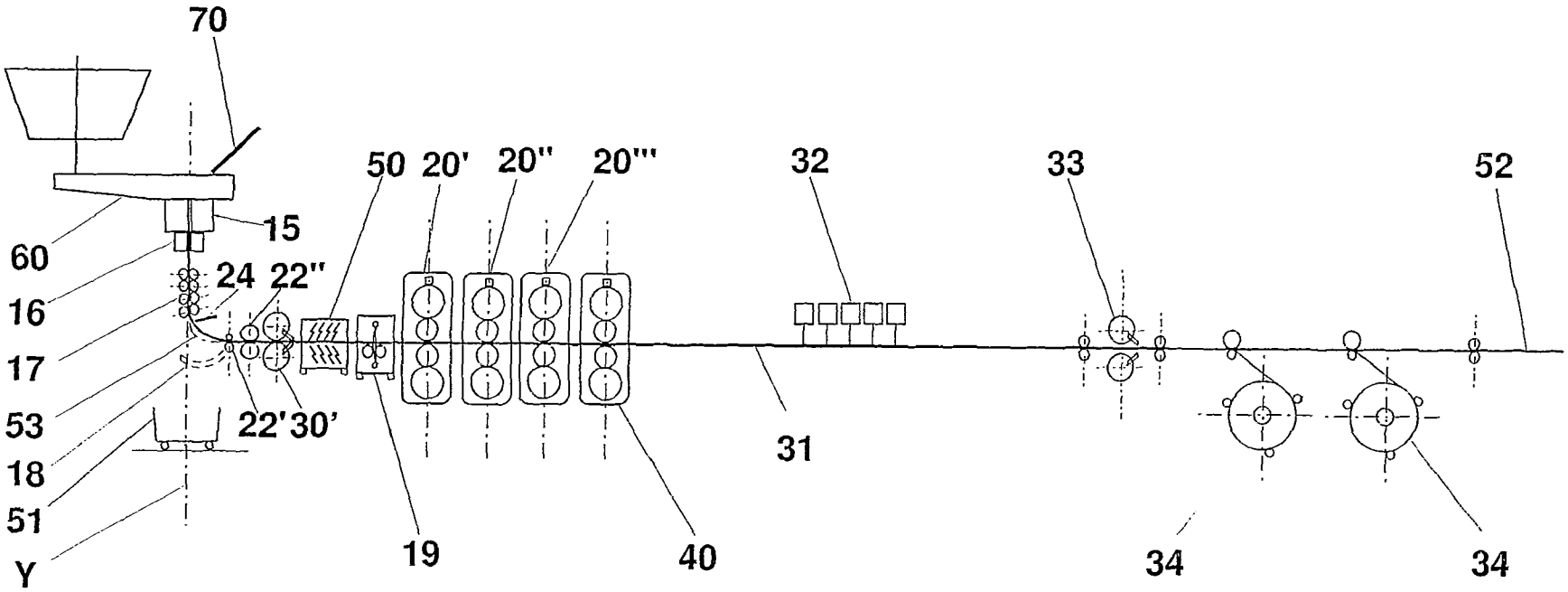
FIG. 1*a* represents a schematic side view of an embodiment of the system according to the invention.
Figure 5:
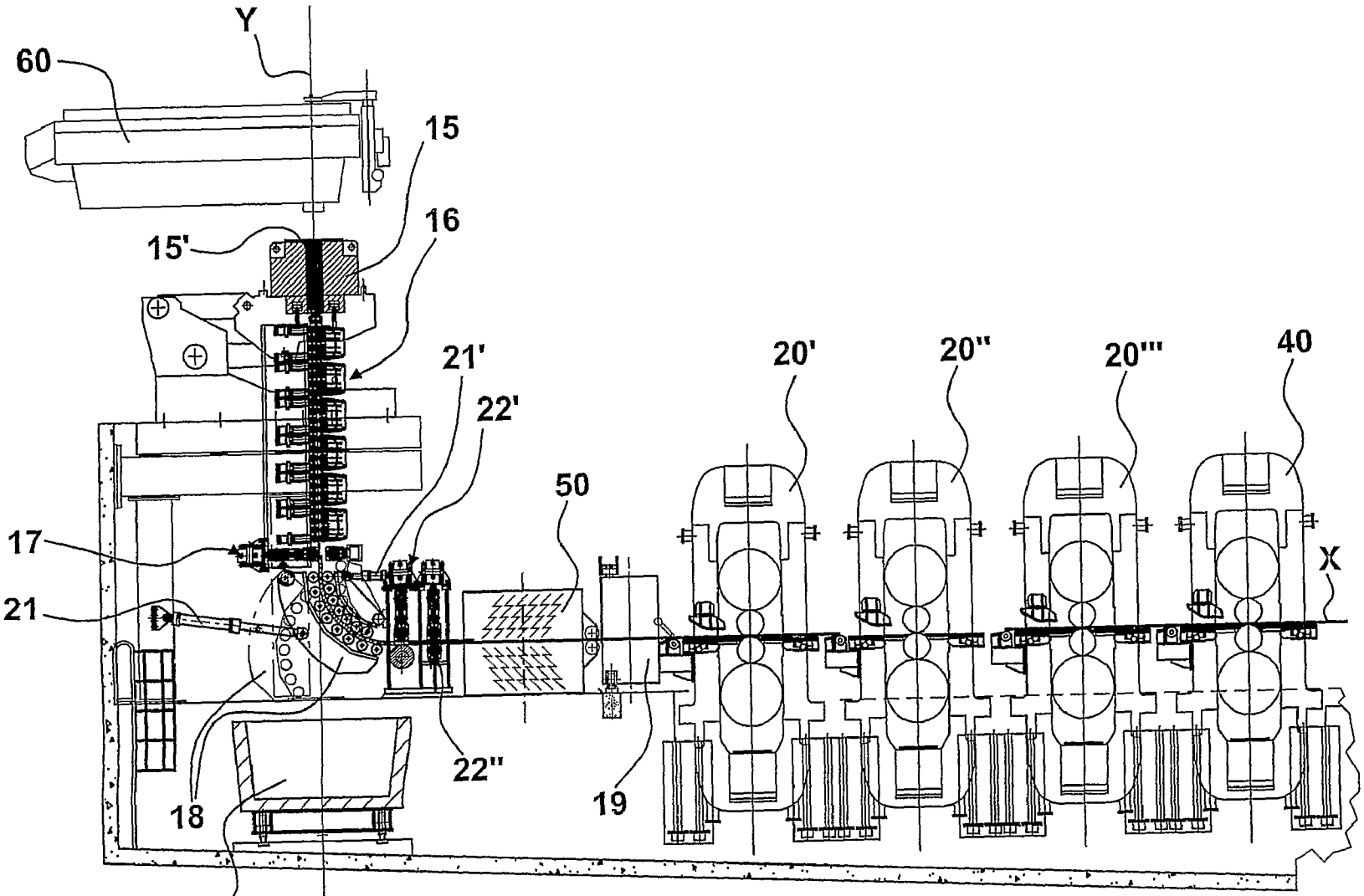
FIG. 5 represents a longitudinal section of a fourth embodiment of part of the system in FIG. 1.
Figure 5A:
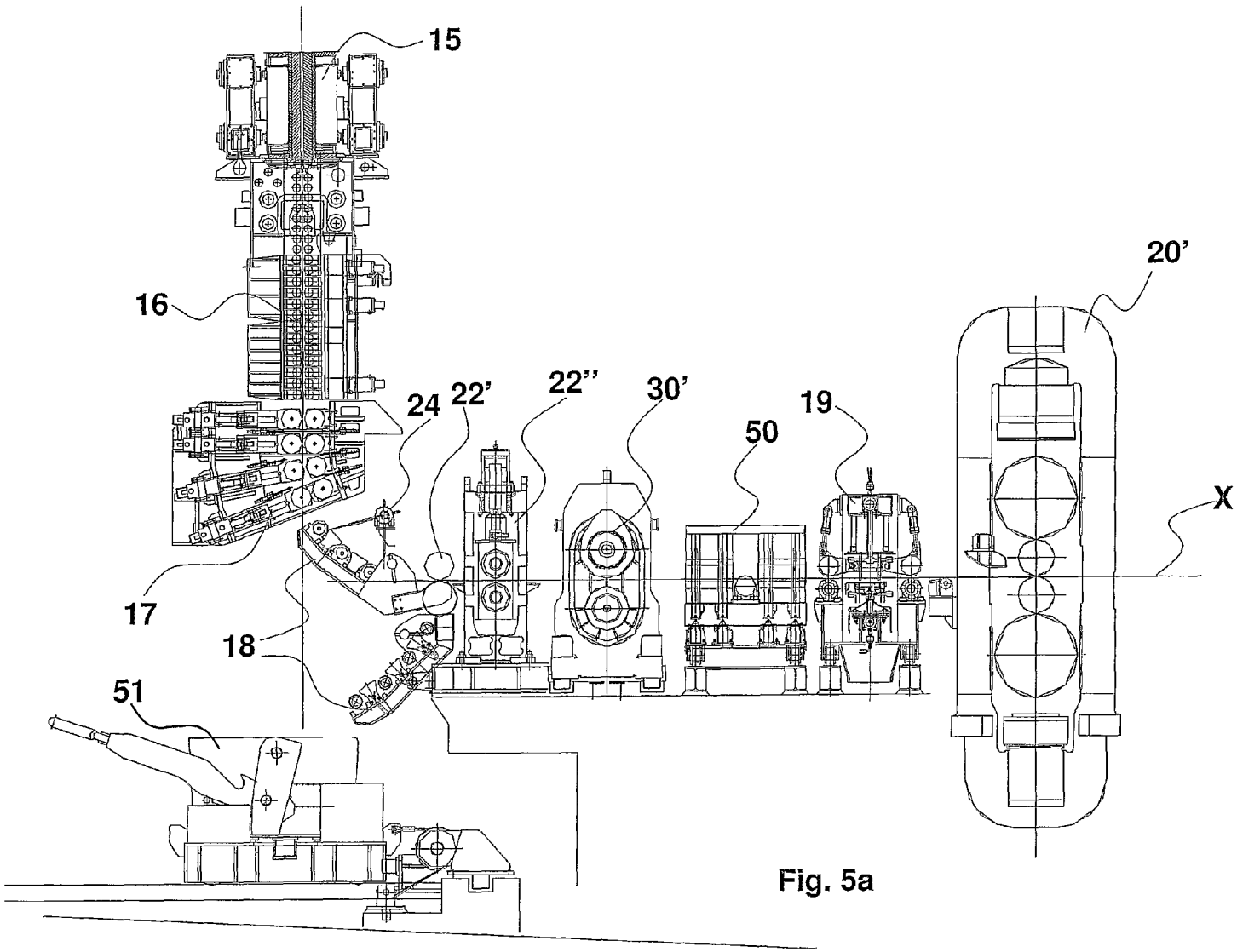
FIG. 5*a* represents a longitudinal section of a fifth embodiment of part of the system in FIG. 1*a;*

The embodiment of the system according to the invention described in FIGS. 1*a* and 5*a* has the following distinctive characteristics compared to the previous embodiments.

the pinch roll 17 consists of a plurality of pairs of rollers arranged in series and forming a basically vertical-curved path; each pair of rollers can perform a light crushing action on the cast slab with a thickness reduction of between 0.1 and 0.7 mm.

The temporary deflecting and guiding device 18 comprises a single curved roller hinged at the right end in relation to the layout of the system illustrated in FIG. 5*a*; the roller conveyor 18 can be selectively operated by means of a hydraulic cylinder (not described) that moves it from a working position, in which it cooperates with the last rollers of the pinch roll 17 closing the curve with the horizontal casting direction, to a disengaged position in which it is lowered, and vice versa.

The cutting devices 24 preferably comprise a cutting torch mounted on an arm of a basically elongated shape that is hinged at one of its ends and can move to at least two working positions.

The second pinch roll 22' is advantageously arranged near to the point of rotation of the roller conveyor 18; more precisely, the lower roller of the pinch roll is idle and coaxial to the axis of rotation of the pin, while the upper roller, which is smaller, is powered. The pinch roll 22' does not perform a "hard reduction" on the product.

The third pinch roll and straightening device 22" is scaled to be able to perform a light hard reduction with a reduction in thickness of between 0.5 and 3 mm; it is also advantageously designed to enable quick changing of the cylinders.

Downstream of the third pinch roll and straightening device there are drum shear 30' with rotary cutters in place of the guillotine shear 30 downstream of the rolling mill described in the other variations. The drum shear 30' perform the following operations:

a) at the start of the casting process, they separate the head of the dummy bar and cut long lengths of slab, which are not to be rolled, until the maximum casting speed is reached and, thus, until reaching the normal system operating conditions;

b) in case of a malfunction on the casting line, they cut the tail end of the slab so as to interrupt the continuous process and send the good material for rolling, and subsequently cut lengths until the system stops;

c) in case of a malfunction on the rolling mill, they interrupt the flow of material to the rolls.

The drum shear in this position make it possible to increase output by optimizing waste material during the initial and final stages of the process and managing emergencies.

Downstream of the drum shears there is an inductor that can advantageously be wheeled to be disabled laterally with respect to the production line. In the latter hypothesis, it allows easy access to the drum shear, for example, to change the cutters.

Immediately upstream of the rolling mill there is a rotating descaling device 19 that uses water at a very high pressure and at a very low flow rate; the descaler is advantageously wheeled so that it can be disabled laterally, thus allowing easier maintenance and better access to the first rolling stand.

The rolling mill is made up of four stands

In the event of a cobble on the train during the continuous production process, the production line is freed as follows:

the supply of liquid steel upstream is stopped;

the casting line is freed, with the pinch roll 17 feeding lengths of slab which are then cut by the cutting torch 24; in this phase the arm of the cutting torch is angled so that the cut is performed immediately after the pinch roll 17;

the rolling line is freed, with the pinch roll 22' moving the product blocked in the rolling mill backward, to be then cut to lengths by the cutting torch; in this phase the arm of the cutting torch 24 is angled so that the cut is performed immediately before the pinch roll 22';

the lengths cut by the cutting torch 24 are collected in the collection bin 51 and then cleared out.

Figure 1B:
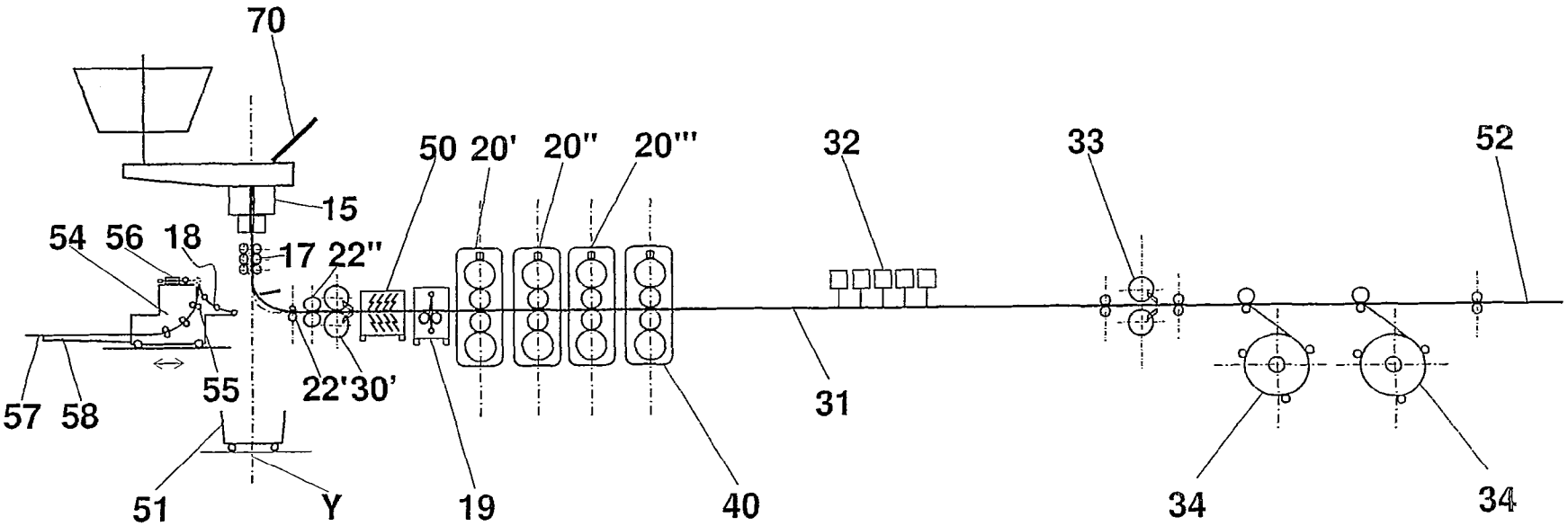
FIG. 1*b* represents a schematic side view of another embodiment of the system according to the invention.

The variation of the system according to the invention described in FIG. 1*b* has the following distinctive characteristics compared to the previous variations.

The roller conveyor 18 is an integral part of a wheeled device 54 sliding sideways with respect to the vertical casting axis.

The wheeled device 54 contains a dummy bar 57 and is provided on the inside with powered rollers 55 to move and guide said dummy bar.

The wheeled device 54 is provided on the outside, preferably in the upper part, with a roller device 56 to separate the head of the dummy bar after the initial phase and complete the joining path provided by the roller conveyor 18; the roller device comprises for example a hydraulic actuator to move a roller.

The wheeled device 54 is provided, in the part opposite the roller conveyor 18, with a supporting surface 58 for the dummy bar 57 and is moved using conventional means, for example a hydraulic cylinder, a rack, etc. (not described in the figure).

The initial phase of the casting process consists of the following steps: the wheeled device 54 is placed vertically beneath the ingot mould so that the roller conveyor 18 follows the curved path to guide the "non-softed" slab; the powered rollers 55 pull the dummy bar out of the wheeled device until, as it passes through the first pinch roll, the rollers of which are appropriately spaced, it is inserted from the bottom into the end part of the crystallizer; the powered rollers 55 pull the dummy bar in the opposite direction thus extracting the first slab; the slab passes the first pinch roll 17, the rollers of which are now in the closed position, the roller device is operated by the respective actuator to separate, in a single blow, the head of the dummy bar from the slab, which is then guided through the curve by the roller of the roller device 56 and by the roller conveyor 18; the wheeled device remains in that position until the steady state speed of the process is reached, for example a speed of 10 m/min, after which it is disabled laterally thus leaving the curve free.

Based on the specific arrangement of the elements included in the system described in the various alternative embodiments, the height of the plane of the ingot mould entrance section, relative to the horizontal rolling axis X of stands 20', 20", 20''', will be lower than 8 m. The length of the casting line, down to the end of the curved deflecting and guiding portion, is thus much shorter than the systems of the known technique.

A preferred embodiment of the system, according to the invention, requires the first rolling stand 20' of the mill to be set at a distance of no more than 11 m from the vertical casting axis Y contained by the vertical exterior plane of the crystallizer 15'. The minimum distance between said first stand 20' and the descaling device 19 is advantageously equal to about 2 m. The reduced length of the casting line between the crystallizer and the first rolling stand advantageously allows little scale formation on the cast product: thus, this allows the possibility to use a less powerful descaling device, with less water and energy consumption, less cooling of the cast product and less formation of vapor.

According to the present invention, this system and this process make it possible to obtain a finished product in a very limited space without discontinuity in the production line. As a matter of fact, the casting process via the crystallizer 15', allows for the possibility to cast a starting product, i.e. the slab thereof, at high speed and with a thickness which is already very close to that of the finished product, namely the strip. Advantageously, the thickness of these thin slabs, when exiting the crystallizer 15, is between 15 and 50 mm and their casting speed is between 4 and 16 m/min.

Therefore, the invention enables the continuous transformation of the liquid steel, arriving from the steel plant, into coils of high quality thin steel strip at competitive costs in a single extremely compact and highly flexible cycle. The overall length of the strip production process according to the invention is between 50 and 70 m, measured from the vertical casting axis Y, contained between the vertical exterior plane of the crystallizer 15', and the axis of the second coiler.

The hot rolled strip obtained using the system and process according to the invention has ever better mechanical properties than similar products obtained using conventional casting and hot rolling systems which means that, for many applications, the subsequent cold rolling process, required when using conventional systems, is no longer necessary. This will lead to considerable savings in terms of investment and production costs, besides a significant reduction in energy consumption and improved environmental compatibility.

The invention claimed is:

1. A process for the continuous production of hot rolled metal strips including:

providing an ingot mould with a built-in crystallizer and a liquid core pre-rolling device located near the exit section of the crystallizer;

providing a first pinch roll and a path deflecting and guiding device operated at least during predetermined periods of time;

providing a second pinch roll;

providing a third pinch roll and straightening device;

providing heating devices and/or devices to keep the heat constant;

providing a descaling device and at least three rolling stands, wherein the process comprises the following stages without intermediate interruptions:

a) casting of a thin slab exiting the crystallizer at a speed of 4-16 m/min, with narrow sides between 15 and 50 mm and a core in which the metal is in a liquid state, b) implementation of a soft reduction of the slab through said pre-rolling device so as to obtain a completely solidified cast product with thickness between 15 and 40 mm, c) formation on the cast product of a free curve not confined in one or more dimensions, the free curve located between said first and said second pinch roll, d) implementation of a descaling operation on the cast product using said descaling device, e) implementation in succession of a plurality of rolling operations through said rolling stands on the cast product, thus eventually defining a strip with thickness between 0.8 and 12 mm.

2. Process according to claim 1, wherein after stage c) a heating operation and/or operation for keeping the heat constant through said heating devices and/or devices for keeping the heat constant is implemented so as to obtain at the exit of the last rolling stand a temperature of the cast product of not less than 850° C.

3. Process according to claim 2, wherein the heating operation is performed by means of an inductor.

4. Process according to claim 3, wherein said inductor is on or off according to a mass flow.

5. Process according to claim 2, wherein the operation to keep the heat constant is performed by means of insulated hoods or insulating panels.

6. Process according to claim 2, wherein said liquid core pre-rolling operation is dynamically controlled during transient phases of the process.

7. Process according to claim 2, wherein, between stage b) and stage c), a first rolling operation is carried out on the cast product so as to achieve a pre-strip via said first pinch roll.

8. Process according to claim 7, wherein the thickness of the pre-strip is between 12 and 37 mm.

9. Process according to claim 7, wherein, after stage c), a second rolling operation is carried out on said pre-strip via the second or third pinch roll.

10. Process according to claim 9, wherein, with the second rolling operation, a pre-strip thickness of 9-34 mm is achieved.

11. Process according to claim 10 wherein, at the exit of the rolling stands, the strip undergoes a laminar water cooling process, it is cut to the required size by a flying shear and is wound in rolls around at least two coilers.

12. Process according to claim 2, wherein, upstream of stage a), in a tundish containing molten steel, a second heating operation is carried out with second heating devices in order to constantly maintain a superheat of the molten liquid in the tundish at about 20° C. during the casting process.

13. Process according to claim 12, wherein the molten steel is unloaded from the tundish to the crystallizer through a multiport unloading device, in which the flow of the steel exiting the unloading device is modulated by electromagnetic devices adjusting the parts of flow which bring molten steel toward the meniscus and toward the lateral zones of the crystallizer, according to the casting speed.

14. Process according to claim 1, wherein said free curve is basically in the shape of a semicircular arc under normal system operating conditions.

15. Process according to claim 14, wherein, during stage c), a free curve position control operation is carried out with a probe.

16. Process according to claim 1, wherein the power used by the beating devices and the water flow rate sent to the descaling device during stage d) are adjusted according to the casting parameters.

* * * * *